US010692347B2

(12) United States Patent
Yang

(10) Patent No.: US 10,692,347 B2
(45) Date of Patent: Jun. 23, 2020

(54) SMART TOILET AND SAFETY MONITORING SYSTEM BASED ON SMART TOILET

(71) Applicant: BOE TECHNOLOGY GROUP CO., LTD., Beijing (CN)

(72) Inventor: Xiangdong Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/334,062

(22) PCT Filed: May 14, 2018

(86) PCT No.: PCT/CN2018/086655

§ 371 (c)(1),
(2) Date: Mar. 18, 2019

(87) PCT Pub. No.: WO2018/223812

PCT Pub. Date: Dec. 13, 2018

(65) Prior Publication Data

US 2019/0272727 A1 Sep. 5, 2019

(30) Foreign Application Priority Data

Jun. 7, 2017 (CN) ..... 2017 1 0423036

(51) Int. Cl.
*G08B 21/04* (2006.01)
*E03D 5/10* (2006.01)
(Continued)

(52) U.S. Cl.
CPC ..... *G08B 21/0492* (2013.01); *E03D 5/10* (2013.01); *G08B 21/02* (2013.01); *G08B 21/043* (2013.01); *G08B 25/10* (2013.01)

(58) Field of Classification Search
CPC .... G08B 21/0492; G08B 25/10; G08B 21/02; G08B 21/043; E03D 5/10
See application file for complete search history.

(56) References Cited

U.S. PATENT DOCUMENTS 9,361,778 B1 * 6/2016 German ..... G08B 21/0423
9,595,185 B1 * 3/2017 Hall ..... G01G 23/3735
(Continued)

FOREIGN PATENT DOCUMENTS

CN 101538887 A 9/2009
CN 201402390 Y 2/2010
(Continued)

OTHER PUBLICATIONS

International Search Report and Written Opinion in corresponding International Patent Application No. PCT/CN2018/086655 dated Jul. 13, 2018 (an English translation attached hereto). 14 pages.
(Continued)

*Primary Examiner* — Ryan W Sherwin
(74) *Attorney, Agent, or Firm* — Leason Ellis LLP

(57) ABSTRACT

A safety monitoring system based on a smart toilet and a smart toilet are provided. The monitoring system includes a smart toilet, and a cloud server. The smart toilet is configured to detect toilet usage time of a user, and transmit the toilet usage time to the cloud server. The cloud server generates first prompt information, and transmits the first prompt information to the smart toilet. The smart toilet is further configured to prompt, according to the first prompt information, a user when the first prompt information is received.

11 Claims, 5 Drawing Sheets

(51) Int. Cl.
*G08B 21/02* (2006.01)
*G08B 25/10* (2006.01)

(56) References Cited

U.S. PATENT DOCUMENTS

| | | | | |
|---|---|---|---|---|
| 2010/0134300 | A1* | 6/2010 | Fukai | G08B 21/0423 340/573.1 |
| 2016/0217670 | A1* | 7/2016 | Kay | G08B 21/0492 |
| 2016/0281344 | A1* | 9/2016 | Lee | E03D 5/04 |
| 2017/0254060 | A1* | 9/2017 | Hall | E03D 11/02 |
| 2017/0260733 | A1* | 9/2017 | Gann | E03D 5/08 |

FOREIGN PATENT DOCUMENTS

| | | | |
|---|---|---|---|
| CN | 103927852 | A | 7/2014 |
| CN | 104167078 | A | 11/2014 |
| CN | 105125134 | A | 12/2015 |
| CN | 204883254 | U | 12/2015 |
| CN | 105242600 | A | 1/2016 |
| CN | 105700488 | A | 6/2016 |
| CN | 105714897 | A | 6/2016 |
| CN | 105747981 | A | 7/2016 |
| CN | 205451392 | U | 8/2016 |
| CN | 106373336 | A | 2/2017 |
| CN | 205975870 | U | 2/2017 |
| CN | 106991787 | A | 7/2017 |
| EP | 1036384 | A2 | 9/2000 |
| JP | 2015087882 | A | 5/2015 |
| JP | 5900941 | B1 | 4/2016 |
| WO | 2016162216 | A1 | 10/2016 |

OTHER PUBLICATIONS

Chinese Office Action in corresponding Chinese Application No. 201710423036.4 dated Sep. 27, 2018 (an English translation attached hereto). 25 pages.

* cited by examiner

SMART TOILET AND SAFETY MONITORING SYSTEM BASED ON SMART TOILET

REFERENCE TO RELATED PATENT APPLICATIONS

This application is a U.S. National Stage Application under 35 U.S.C. § 371 of International Patent Application No. PCT/CN2018/086655, filed May 14, 2018, which claims the benefit of priority to Chinese patent application No. 201710423036.4, filed Jun. 7, 2017, both of which are incorporated by reference in their entireties as part of the application.

TECHNICAL FIELD

Embodiments of the present disclosure relate to a safety monitoring system based on a smart toilet, and a smart toilet.

BACKGROUND

At present, with the change in the age structure of the population, China will gradually become aging. However, China's endowment pattern is still dominated by family pension, while children in the family are relatively few. At this time, if children (especially only child) need to support many elderly people at the same time, there will inevitably be conflicts between work and caring for the elderly.

For this reason, the known technology has disclosed that the type of activity of the elderly (such as entering and leaving the bathroom, flushing, fainting in the ground, entering and leaving the house, etc.) is detected, and when the toilet is not used for a long time and the user goes into the bathroom for a long time, corresponding alarm signal is generated, and the generated alarm information is transmitted to the family's mobile phone, a specific monitoring center, or upload to the network side; or an action path for the elderly is established, and the health status or living rules of the elderly are obtained by analysis according to the path. However, the accuracy is poor by determining possible danger only by the case that the toilet is not used for a long time or the user goes into the bathroom for a long time or obtaining the health status or living rules of the elderly according to the action path, and inconvenience can be brought to the user, so the user experience will not be good.

SUMMARY

An embodiment of the disclosure provides a safety monitoring system based on a smart toilet.

Another embodiment of the disclosure provides a smart toilet.

Still another embodiment of the disclosure provides a cloud server.

Still another embodiment of the disclosure provides a mobile terminal.

An embodiment of the disclosure provides a safety monitoring system based on a smart toilet, comprising a smart toilet, a cloud server and a mobile terminal, wherein the smart toilet is configured to detect a toilet time of a user and send the toilet time to the cloud server; the cloud server is configured to store a toilet data model of the user, analyze the toilet time according to the toilet data model, generate first prompt information or first alarm information, send the first prompt information to the smart toilet, or send the first alarm information to the mobile terminal; the smart toilet is further configured to prompt the user according to the first prompt information when receiving the first prompt information; and the mobile terminal is configured to give an alarm in a first way when receiving the first alarm information.

Another embodiment of the disclosure provides a safety monitoring method comprises: allowing the smart toilet to detect the toilet time of the user and send the toilet time to a cloud server; allowing the cloud server to generate first prompt information or first alarm information by analyzing the toilet time according to a stored toilet data model, send the first prompt information to the smart toilet, or send the first alarm information to a mobile terminal; and allowing the smart toilet to prompt the user according to the first prompt information when receiving the first prompt information, or allowing the mobile terminal to give an alarm in the first way when receiving the first alarm information.

Another embodiment of the disclosure provides a smart toilet, comprising: a time detection module configured to detect toilet time of a user; a first communication module configured to establish communication connection between the smart toilet and a cloud server and send the toilet time to the cloud server based on the communication connection between the smart toilet and the cloud server, so that the cloud server analyzes the toilet time according to a stored toilet data model, generate first prompt information, and send the first prompt information to the smart toilet; and a prompt module configured to prompt the user according to the first prompt information when receiving the first prompt information.

Still another embodiment of the disclosure provides a cloud server comprises: a second communication module, configured to establish communication connection between the cloud server and the smart toilet, and receive the toilet time of the user, detected and sent by the smart toilet, based on the communication connection between the cloud server and the smart toilet; a storage module, configured to store a toilet data model of the user; a processing module, configured to generate first prompt information or first alarm information by analyzing the toilet time according to the toilet data model of the user and a third communication module; and a third communication module, configured to establish communication connection between the cloud server and the mobile terminal, and send the first alarm information to the mobile terminal based on the communication connection between the cloud server and the mobile terminal, so that the mobile terminal give an alarm in the first way when receiving the first alarm information, wherein the second communication module is also configured to send the first prompt information to the smart toilet based on the communication connection between the cloud server and the smart toilet, so that the smart toilet prompt the user according to the first prompt information when receiving the first prompt information.

Still another embodiment of the disclosure provides a mobile terminal comprises: a fourth communication module, configured to establish communication connection between the mobile terminal and the cloud server; and an application (APP), configured to receive the first alarm information sent by the cloud server through the fourth communication module, and give an alarm in the first way according to the first alarm information, wherein, the smart toilet sends the detected toilet time of the user to the cloud server, and the cloud server generates first alarm information by analyzing the toilet time according to the stored toilet data model.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiment will be described in a clearly and fully understandable way in connection with the drawings related to the embodiments of the disclosure. It is obvious that the described embodiments are just a part but not all of the embodiments of the disclosure. Based on the described embodiments herein, those skilled in the art can obtain other embodiment(s), without any inventive work, which should be within the scope of the disclosure.

Description will be given below to the safety monitoring system and method based on the smart toilet, the smart toilet, the cloud server and the mobile terminal, provided by the embodiment of the present disclosure, with reference to the accompanying drawings.

Figure 1:
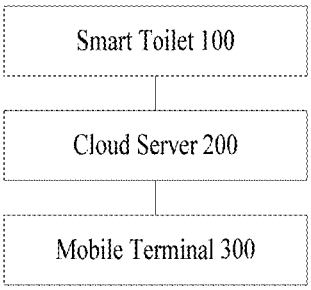
FIG. 1 is a block diagram of a safety monitoring system based on a smart toilet, provided by the embodiment of the present disclosure.

FIG. 1 is a block diagram of a safety monitoring system based on a smart toilet, provided by the embodiment of the present disclosure. As shown in FIG. 1, the safety monitoring system comprises a smart toilet 100, a cloud server 200 and a mobile terminal 300.

The smart toilet 100 is configured to detect the toilet time of the user and send the toilet time to the cloud server 200. The cloud server 200 stores a toilet data model of the user, generates first prompt information or first alarm information by analyzing the toilet time according to the toilet data model of the user, sends the first prompt information to the smart toilet 100, or sends the first alarm information to the mobile terminal 300. The smart toilet 100 is also configured to prompt the user according to the first prompt information when receiving the first prompt information. The mobile terminal 300 is configured to give an alarm in the first way when receiving the first alarm information.

In one embodiment of the present disclosure, the smart toilet 100 includes a toilet seat a. The smart toilet 100 can acquire the toilet time of the user according to the time of the user sitting on the toilet seat a. For instance, the pressure applied by the user to the toilet seat a when going to the toilet can be detected, and whether the pressure is within certain range is determined; if so, it can be determined that the user starts to go to the toilet, and at this point, timing begins; and if the pressure is not within the certain range, timing stops. Whether the skin contacts the toilet seat a can also be detected; if so, timing begins; if not, timing stops; and the timing time is the detected toilet time of the user.

For instance, the toilet data model of the user may include regular toilet time for normal people in the age group of the user, the doctor's recommended toilet time, etc. The first prompt information can be to remind the user that the body is slightly abnormal, the user needs to pay attention to rest, the user needs to drink more water, etc. The first alarm information can be to inform the user of the mobile terminal 300 (generally the user's family, such as the child of the elderly) that the user's body may be ill and needs to be checked. The first way can be "Ding Ding Ding" alarm sound, vibration or voice prompt, etc.

For instance, the smart toilet 100 sends the detected toilet time of the user to the cloud server 200; the cloud server 200 determines whether the toilet time is greater than set time such as the doctor's recommended toilet time; and if so, the cloud server 200 generates the first alarm information and sends the first alarm information to the mobile terminal 300. The cloud server 200 may send the first alarm information to the mobile terminal 300 in the form of short message, and correspondingly, the mobile terminal 300 may also given an alarm in the form of short message; and the cloud server 200 may also forward the first alarm information to corresponding application (APP) in the mobile terminal 300, so that the mobile terminal 300 can prompt the user by a mode set by the APP, e.g., "Ding Ding Ding" alarm sound, vibration or voice prompt.

If the toilet time is less than the doctor's recommended toilet time, the cloud server 200 further determines whether the toilet time is greater than the regular toilet time; if so, the cloud server 200 generates first prompt information such as "Your body is slightly ill, please pay attention to rest, drink plenty of water" and sends the first prompt information to the smart toilet 100; and the smart toilet 100 plays this message to prompt the user.

Thus, the user or his family can be made aware of the health status of the user in time, and it is convenient to take preventive measures in time when the user's health deteriorates.

It can be understood that the safety monitoring system based on the smart toilet, provided by the embodiment of the present disclosure, is mainly applicable to the safety monitoring of the elderly at home.

Figure 2:
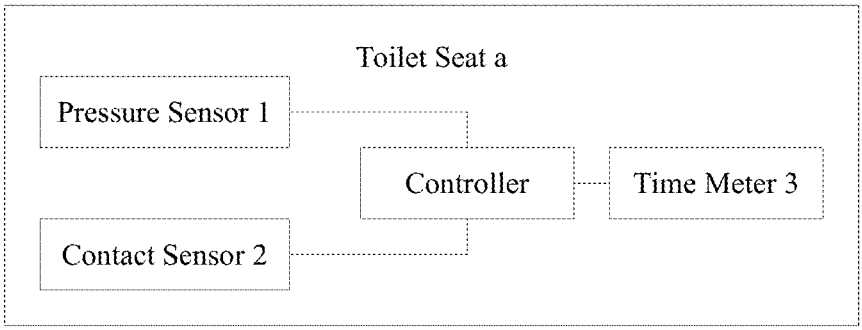
FIG. 2 is a block diagram of a toilet seat of a smart toilet provided by one embodiment of the present disclosure.

In one embodiment of the present disclosure, as shown in FIG. 2, the smart toilet 100 includes a toilet seat a; a pressure sensor 1, a contact sensor 2 and a time meter 3 are disposed on the toilet seat a; the pressure sensor 1 is configured to detect the pressure applied by the user to the toilet seat a when going to the toilet; and the contact sensor 2 is configured to detect whether the skin contacts the toilet seat a. Wherein, when the pressure detected by the pressure sensor 1 is greater than the preset pressure and the contact sensor 2 detects that the skin contacts the toilet seat a, the time meter 3 starts timing; and when the pressure detected by the pressure sensor 1 is less than or equal to the preset pressure or the contact sensor 2 detects that the skin does not contact the toilet seat a, the time meter 3 stops timing, and the smart toilet 100 acquires the toilet time of the user according to the timing time of the time meter 3. It can be understood that in order to realize the control of the time meter 3, as shown in FIG. 2, a controller may be disposed on the toilet seat a, and the controller is adopted to control the time meter 3 according to the detection result of the pressure sensor 1 and the contact sensor 2.

For instance, the pressure sensor 1 may be disposed on a contact part between the toilet seat a and the toilet, for instance, disposed on a support for supporting the toilet seat a, at the bottom of the toilet seat a; if the number of the pressure sensor 1 is 1, the pressure sensor 1 may be disposed on one support; and if the number of the pressure sensors 1 is multiple, the pressure sensors 1 may be respectively disposed on a plurality of corresponding supports. The pressure sensor 1 may also be disposed on an upper surface of the toilet seat a, and can detect the pressure applied by the user to the toilet seat a when the user sits on the toilet seat a.

The preset pressure may be set according to actual pressure. For instance, if the user naturally sits on the toilet seat a, the pressure applied to the toilet seat a is m, e.g., 450N, as for the pressure sensor 1 disposed on one support among 3 supports, the preset pressure may be a value less than m/3, e.g., 100N; as for 3 pressure sensors 1 respectively disposed on the 3 supports, the preset pressure may be a value less than m, e.g., 300N; and as for one pressure sensor 1 disposed on a surface of the toilet seat a, the preset pressure may be a value less than m, e.g., 200N. It can be understood that the preset pressure 1 may be set according to the result of multiple tests for the pressure sensors 1 in different arrangement modes.

For instance, the contact sensor 2 may be a temperature sensor disposed on an upper surface of the toilet seat a; when the user sits on the toilet seat a and the skin contacts the toilet seat a, the temperature sensor will detect the temperature of the skin of the user; and when the temperature detected by the temperature sensor changes significantly, it can be determined that the skin contacts the toilet seat a.

For example, as for one pressure sensor 1 disposed on one support and the temperature sensor disposed on the surface of the toilet seat a, when the pressure detected by the pressure sensor 1 is 170N which is greater than the preset pressure 100N, the temperature detected by the temperature sensor is converted from 22° C. to 34° C., and the controller can control the time meter 3 disposed on the toilet seat a to start timing; and when the pressure detected by the pressure sensor 1 is 10N which is less than 100N, or when the temperature detected by the temperature sensor is converted into 24° C., the time meter 3 can be controlled to stop timing, and the continuous timing time of the time meter 3 is one toilet time of the user.

It should be noted that if the user sways during the toilet time or momently gets up, the pressure detected by the pressure sensor 1 is less than the preset pressure, or the contact sensor 2 detects that the skin does not contact the toilet seat a; the controller can determine whether the duration of this situation is less than the set time, e.g., 2*s*; and if so, the time meter 3 does not stop timing.

Figure 3:
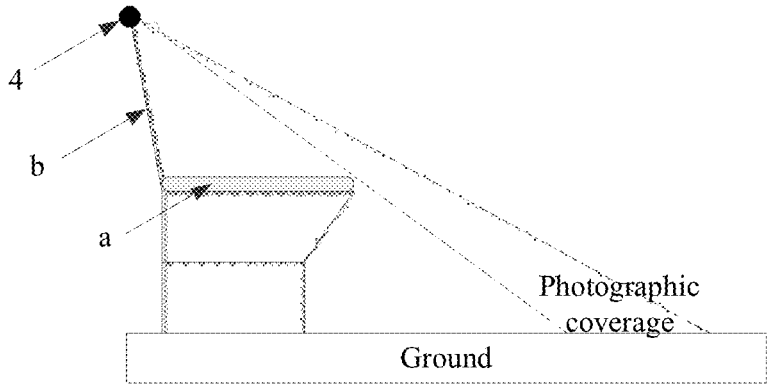
FIG. 3 is a schematic diagram illustrating fall detection of the smart toilet provided by one embodiment of the present disclosure.

In one embodiment of the present disclosure, as shown in FIG. 3, the smart toilet 100 may further include a toilet lid b, and a camera 4 is disposed on the toilet lid b. The smart toilet 100 may also be configured to detect the behavioral posture of the user through an image of the user captured by the camera 4, determine whether the user falls according to the behavioral posture, and generate second alarm information when the user falls; and then the cloud server 200 sends the second alarm information to the mobile terminal 300. Wherein, the mobile terminal 300 is also configured to give an alarm in the second way when receiving the second alarm information.

For instance, after seeing the second alarm information, the user's family on the mobile terminal 300 can input a voice connection instruction for the APP; the mobile terminal 300 generates voice connection information according to the instruction and sends the voice connection information to the cloud server 200; the cloud server 200 realizes the voice communication between the mobile terminal 300 and the smart toilet 100 according to the voice connection information; and then the user's family can communicate with the user to understand the current situation of the user in real time.

For instance, as shown in FIG. 3, the camera 4 may be disposed on a front edge of the toilet lid b. In the normal use process, the camera 4 captures an image of the user and the ground, and the smart toilet 100 can determine whether the human body is in a falling state by recognition of an image of the human body relative to the ground. In the falling situation, the smart toilet 100 generates second alarm information; the cloud server 200 sends the second alarm information to the mobile terminal 300; and the mobile terminal 300 gives an alarm in the second way, for instance, a voice prompt "Attention,  falls in the bathroom", "Ding Ding Ding" sound, or a vibration alarm. Thus, the user of the mobile terminal 300** (generally the family of the user who falls over) can know in time that the user falls in the bathroom, and then can take corresponding measures, such as voice communication with the user, and timely deal with the fall injury, thereby reducing the degree of injury. It can be understood that when the user does not fall, only the two feet touch the ground, and when the user falls, the contact area between the user and the ground become large, so whether the user falls can be determined.

For instance, in order to prevent leakage of user privacy information, the smart toilet 100 may adopt human contour tracking algorithm, that is, the current posture of the human body is determined only through the position of the human body relative to the ground. For instance, when the user is standing, the outline of the feet and the lower leg is photographed, and when the user falls, the body contour of the user is photographed.

It should be noted that the smart toilet 100 may also play suggested information such as "Do not move, wait for people to enter" to avoid secondary injury caused by interaction when detecting user fall and generating the second alarm information.

In addition, in one embodiment of the present disclosure, in order to facilitate the integration of the smart toilet 100, the camera 4 may be disposed on the front edge of the toilet seat a and may be connected with the controller in FIG. 2, and the controller may be adopted to analyze whether the user falls according to the image captured by the camera 4.

In one embodiment of the present disclosure, the mobile terminal 300 may also be configured to generate confirmation information according to an input instruction and send the confirmation information to the cloud server 200, so that the cloud server 200 can stop sending the first alarm information and/or the second alarm information.

For instance, in order to prevent the family of the user on the side of the mobile terminal 300 from missing the alarm information, the cloud server 200 may send the first alarm information and/or the second alarm information to the mobile terminal 300 at preset time intervals (e.g., 45*s*). The mobile terminal 300 can input corresponding confirmation instruction after confirming that the alarm information is received, so that the cloud server 200 can stop sending the alarm information, and meanwhile, the smart mobile 100 can also stop playing the suggested information.

In another embodiment of the present disclosure, the mobile terminal 300 may also generate view information according to the input instruction and display the health status of the user that goes to the toilet pushed by the cloud server 200 according to the view information. For instance, the child of the elderly can access the cloud server 200 through the APP of the mobile terminal 300 and view the change in the toilet time or the toilet frequency of corresponding elderly pushed by the cloud server 200, so the child can pay attention to the health status of the elderly in time.

In order to realize the pointed monitoring of the user, in one embodiment of the present disclosure, the mobile terminal 300 may also enter identity information, health data and control parameters of a user to be monitored and ID information of the smart toilet 100 according to a received information entry instruction, and send the identity information, the health data and the control parameters of the user to be monitored and the ID information of the smart toilet 100 to the cloud server 200. The cloud server 200 may also establish a toilet data model based on the smart toilet 100 according to the identity information, the health data and the control parameters of the user to be monitored and the ID information of the smart toilet 100.

For instance, the identity information may include but not limited to fingerprint information, age, gender and the like of the user to be monitored; the health data include but not limited to the disease conditions (e.g., high blood pressure, high blood sugar, high blood fat, etc.) of the user to be monitored; and the control parameters include but not limited to the regular toilet time for normal people in the age group of the user to be monitored, and the recommended toilet time provided by the doctor based on the health status of the user to be monitored.

Figure 4:
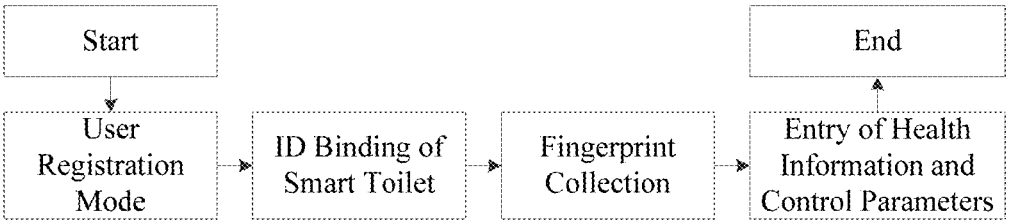
FIG. 4 is a flowchart illustrating the process of entering information of a user to be monitored into a mobile terminal in one embodiment of the present disclosure.

For instance, as shown in FIG. 4, the user opens the APP of the mobile terminal 300, enters the user registration mode of the APP, and can input the ID of the smart toilet 100 according to the prompt at first to bind the smart toilet 100; and subsequently, collects fingerprint information of the user to be monitored (e.g., the elderly), and enters the health data and control parameters of the elderly according to APP settings after fingerprint entry. After the completion of entry, the cloud server 200 establishes a toilet data model based on the smart toilet 100 according to the entry information, and meanwhile, the fingerprint information of the user to be monitored can be sent to corresponding smart toilet 100 through the cloud server 200. It can be understood that information of a plurality of users to be monitored can be entered through the APP of the mobile terminal 300, and then the toilet data models of the plurality of users to be monitored based on the smart toilet 100 can be established through the cloud server 200.

For example, as shown in Table 1, the toilet data model established by the cloud server 200 includes: identity information (e.g., fingerprint information) of the user to be monitored, in which the information can be synchronized with the smart toilet 100; name and date of birth of the user to be monitored corresponding to the fingerprint information, in which the cloud server 200 can calculate the age of the user to be monitored according to the date of birth; control parameters including first preset time (such as the doctor's recommended toilet time), second preset time (such as the regular toilet time), early warning threshold and alarm threshold; and the disease type of the user to be monitored.

TABLE 1

| | | |
|---|---|---|
| Fingerprint Information | For identity synchronization with the smart toilet | |
| Name | Corresponding fingerprint identity | |
| Date of birth | Automatically calculating the user age based on system time | |
| Timing early warning and alarm | Normal toilet time | Regular toilet time for normal people |
| | The doctor's recommended toilet time | Recommended toilet time provided by the doctor based on the health status of the elderly |
| | Disease type | Disease type that causes the elderly to have abnormal toilet time |
| | Early warning threshold | Early warning difference beyond the normal toilet time or the doctor's recommended time |
| | Alarm threshold | The time difference causing the increase in the risk of health uncertainty in the case of too long toilet time |

It should be noted that as for the toilet data model as shown in Table 1, when the toilet time is greater than the early warning difference of the normal toilet time or the doctor's recommended toilet time, the cloud server 200 generates alarm information (such as the first prompt information); and when the toilet time is greater than the alarm threshold of the regular toilet time or the doctor's recommended toilet time, the cloud server 200 generates alarm information (such as the first alarm information).

For instance, the smart toilet 100 may also be configured to collect identity information of the user, verify the identity information, and begin to detect the toilet time of the user and detect whether the user falls when the verification is passed. Wherein, the cloud server 200 may also be configured to acquire a toilet data model corresponding to the identity information when the verification is passed, so as to conveniently analyze the toilet time of the user.

Figure 5:
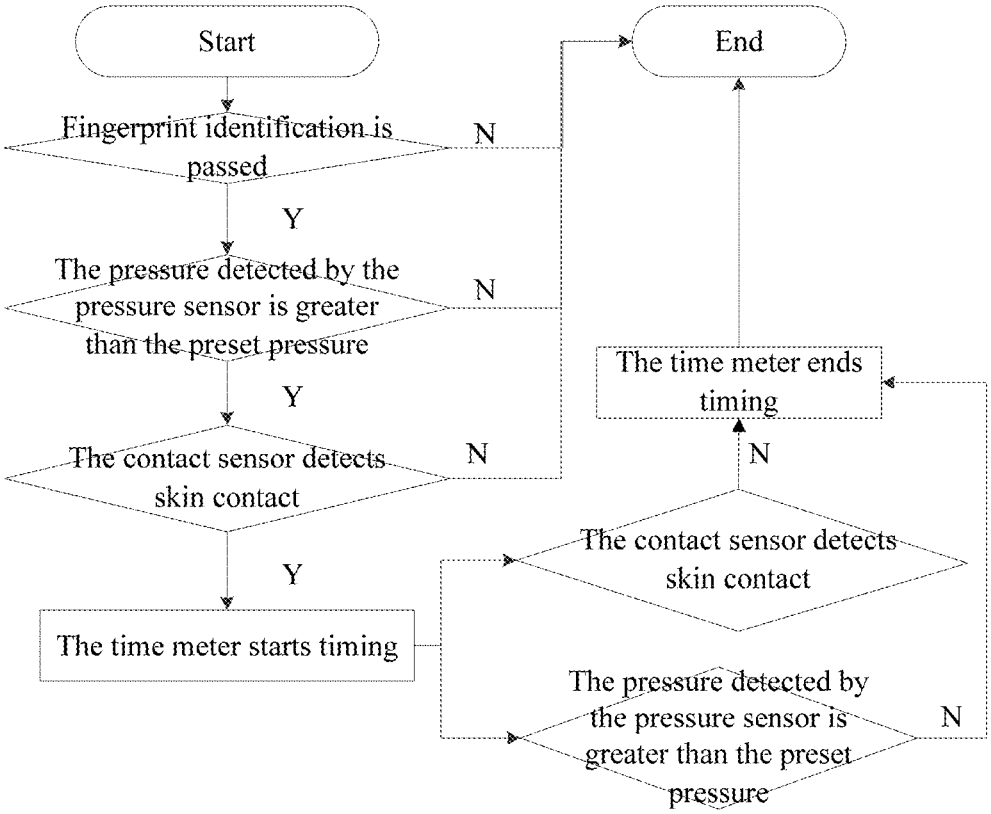
FIG. 5 is a flowchart illustrating the process of detecting the toilet time of the smart toilet provided by one embodiment of the present disclosure.

For instance, a fingerprint identification module may be disposed on the toilet lid b. As shown in FIG. 5, when the user goes to the toilet, fingerprint information of the user can be input at first, and then the fingerprint identification module can identify and verify the identity information of the current user according to the identify information of the user to be monitored stored by the smart toilet 100. After the verification is passed, on one hand, the smart toilet 100 determines whether the pressure detected by the pressure sensor 1 is greater than the preset pressure, if so, determines whether the contact sensor 2 detects that the skin contacts the toilet seat a, and if so, the time meter 3 starts timing; and on the other hand, the cloud server 200 acquires the toilet data model of the current user. When the contact sensor 2 detects that the skin does not contact the toilet seat a or the pressure detected by the pressure sensor 1 is less than the preset pressure, the time meter 3 ends timing, and the timing time of the time meter 3 is the toilet time of the user.

Figure 6:
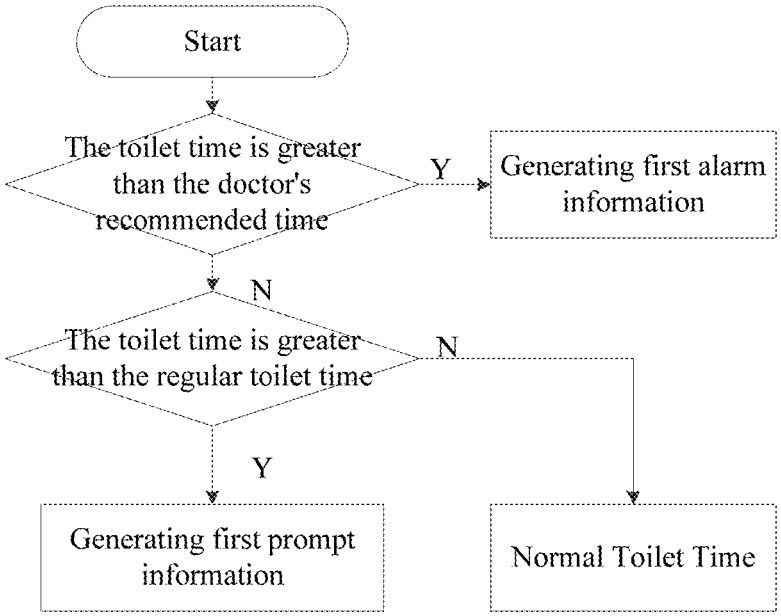
FIG. 6 is a flowchart illustrating the process of analyzing the toilet time by a cloud server in one embodiment of the present disclosure.

For instance, as shown in FIG. 6, the smart toilet 100 sends the toilet time to the cloud server 200, and the cloud server 200 analyzes the toilet time according to the toilet data model of the current user, in which the control parameters in the toilet data model include first preset time (such as the doctor's recommended toilet time) and second preset time (such as regular toilet time for normal people), and the first preset time is greater than the second preset time. If the toilet time is greater than the first preset time, the cloud server 200 generates the first alarm information; and if the toilet time is less than the first preset time and greater than the second preset time, the cloud server 200 generates the first prompt information.

For instance, the cloud server 200 may also analyze the change law of the toilet time. For instance, when the frequency of continuous progressive increase of the toilet time reaches the preset frequency, the cloud server 200 may generate the first alarm information. In addition, the cloud server 200 may also analyze the toilet time point and the toilet frequency, so as to obtain the user's toilet rules for health analysis.

Figure 7:
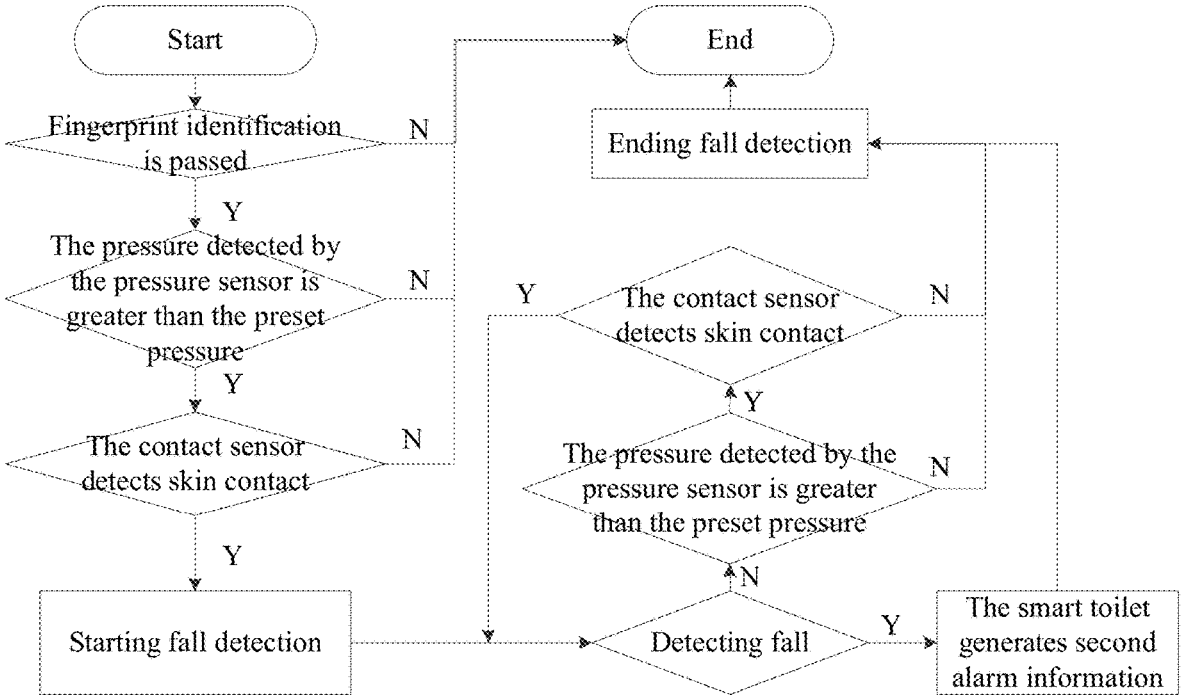
FIG. 7 is a flowchart illustrating fall detection of the smart toilet provided by one embodiment of the present disclosure.

In another embodiment of the present disclosure, as shown in FIG. 7, when going to the toilet, the user can input fingerprint information at first, and then the fingerprint identification module can identify and verify the identity information of the current user according to the identity information of the user to be monitored stored by the smart toilet 100. After the verification is passed, on one hand, the smart toilet 100 determines whether the pressure detected by the pressure sensor 1 is greater than the preset pressure, if so, determines whether the contact sensor 2 detects that the skin contacts the toilet seat a, and if so, the time meter 3 starts timing; and on the other hand, the smart toilet 100 starts fall detection. When user fall is detected, the smart toilet 100 generates the second alarm information.

Figure 8:
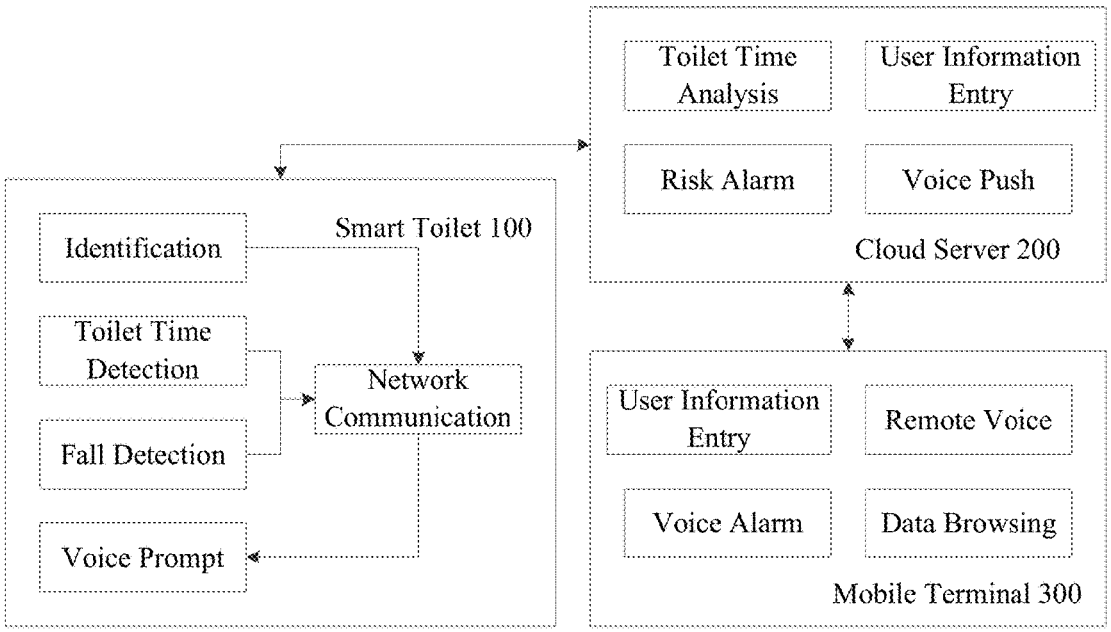
FIG. 8 is a functional block diagram of a safety monitoring system based on a smart toilet, provided by one embodiment of the present disclosure.

For convenient understanding of the safety monitoring system based on the smart toilet provided by the embodiment of the present disclosure, FIG. 8 can be referred, and the specific working principle may refer to the above description.

In summary, the safety monitoring system based on the smart toilet provided by the embodiment of the present disclosure adopts the smart toilet to detect the toilet time of the user and send the toilet time to the cloud server, adopts the cloud server to generate the first prompt information or the first alarm information by analyzing the toilet time according to the toilet data model of the user, and then send the first prompt information to the smart toilet, so that the smart toilet can prompt the user according to the first prompt information, or send the first alarm information to the mobile terminal, so that the mobile terminal can give an alarm in the first way. Thus, the user or his family can be made aware of the health status of the user in time, and it is convenient to take preventive measures in time when the user's health deteriorates. In addition, the smart toilet is adopted to detect whether the user falls and generate the second alarm information when the user falls, and the cloud server is adopted to send the second alarm information to the mobile terminal, so that the mobile terminal can give an alarm in the second way. Thus, the user's family member can take emergency measures against the user's fall in time to reduce or avoid causing greater harm to the user.

Figure 9:
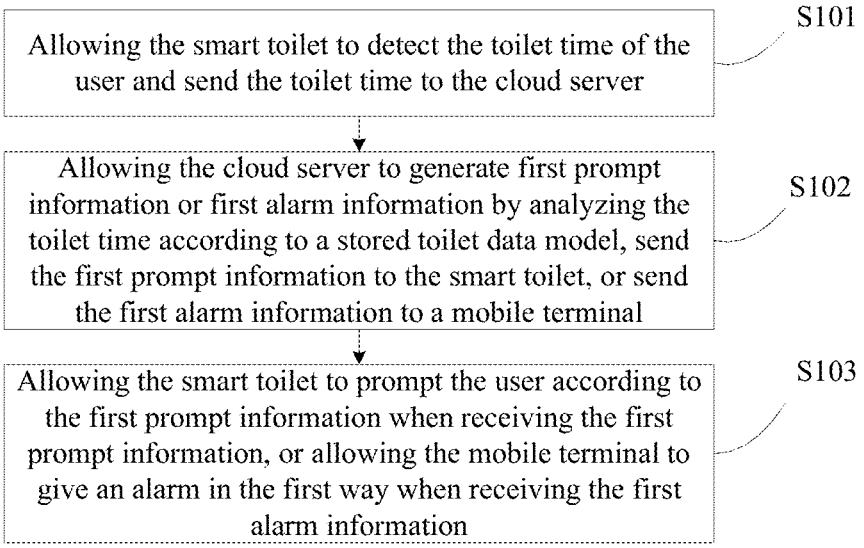
FIG. 9 is a flowchart of the safety monitoring system based on the smart toilet, provided by one embodiment of the present disclosure.

FIG. 9 is a flowchart of a safety monitoring method based on a smart toilet provided by the embodiment of the present disclosure. As shown in FIG. 9, the safety monitoring method comprises the following steps:

S101: allowing the smart toilet to detect the toilet time of the user and send the toilet time to a cloud server.

In one embodiment of the present disclosure, the smart toilet includes a toilet seat, and a pressure sensor, a contact sensor and a time meter may be disposed on the toilet seat, in which the pressure sensor is configured to detect the pressure applied by the user to the toilet seat when going to the toilet, and the contact sensor is configured to detect whether the skin contacts the toilet seat. For instance, when the pressure detected by the pressure sensor is greater than the preset pressure and the contact sensor detects that the skin contacts the toilet seat, the time meter starts timing; and when the pressure detected by the pressure sensor is less than or equal to the preset pressure or the contact sensor detects that the skin does not contact the toilet seat, the time meter stops timing, and the smart toilet acquires the toilet time of the user according to the timing time of the time meter.

S102: allowing the cloud server to generate first prompt information or first alarm information by analyzing the toilet time according to a stored toilet data model, send the first prompt information to the smart toilet, or send the first alarm information to a mobile terminal.

S103: allowing the smart toilet to prompt the user according to the first prompt information when receiving the first prompt information, or allowing the mobile terminal to give an alarm in the first way when receiving the first alarm information.

In one embodiment of the present disclosure, as shown in FIG. 3, the smart toilet further includes a toilet lid, and a camera can be disposed on the toilet lid, so that the smart toilet can detect the behavioral posture of the user through an image of the user captured by the camera and determine whether the user falls according to the behavioral posture. If the user falls, second alarm information is generated and sent to the mobile terminal through the cloud server. Wherein, the mobile terminal gives an alarm in the second way when receiving the second alarm information.

In one embodiment of the present disclosure, the mobile terminal can generate confirmation information according to an input instruction and send the confirmation information to the cloud server, so that the cloud server can stop sending the first alarm information and/or the second alarm information; can generate voice connection information according to the input instruction and send the voice connection information to the cloud server, so that the cloud server can realize the voice communication between the mobile terminal and the smart toilet according to the voice connection information; and can also generate view information according to the input instruction and display the health status of the user that goes to the toilet pushed by the cloud server.

In one embodiment of the present disclosure, in order to ensure the pointed safety monitoring of the user, the safety monitoring method may further comprise: allowing the mobile terminal to enter identity information, health data and control parameters of the user to be monitored and ID information of the smart toilet according to a received information entry instruction, and send the identity information, the health data and the control parameters of the user to be monitored and the ID information of the smart toilet to the cloud server; and allowing the cloud server to establish a toilet data model based on the smart toilet according to the identity information, the health data and the control parameters of the user to be monitored and the ID information of the smart toilet.

The control parameters may include first preset time and second preset time, and the first preset time is greater than the second preset time.

For instance, the cloud server generates the first alarm information when the toilet time is greater than the first preset time or a number of times for which the toilet time has sustainable growth reaches a preset value; and the cloud server generates the first prompt information when the toilet time is less than or equal to the first preset time and greater than the second preset time.

In one embodiment of the present disclosure, the smart toilet can acquire the identity information of the user, verify the identity information, and begin to detect the toilet time of the user and detect whether the user falls when the verification is passed. Wherein, the cloud server acquires the toilet data model corresponding to the identity information when the verification is passed.

It should be noted that the specific embodiments of the safety monitoring method based on the smart toilet, provided by the embodiment of the present disclosure, may refer to the specific embodiments of the safety monitoring system based on the smart toilet provided by the embodiment of the present disclosure, so no further description will be given here to reduce redundancy.

In the safety monitoring method based on the smart toilet provided by the embodiment of the present disclosure, the smart toilet is adopted to detect the toilet time of the user and send the toilet time to the cloud server; and the cloud server is adopted to generate the first prompt information or the first alarm information by analyzing the toilet time according to the toilet data model of the user, and then send the first prompt information to the smart toilet, so that the smart toilet can prompt the user according to the first prompt information, or send the first alarm information to the mobile terminal, so that the mobile terminal can give an alarm in the first way. Thus, the user or his family can keep abreast of the user's health status, and take preventive measures when users' health deteriorates.

Figure 10:
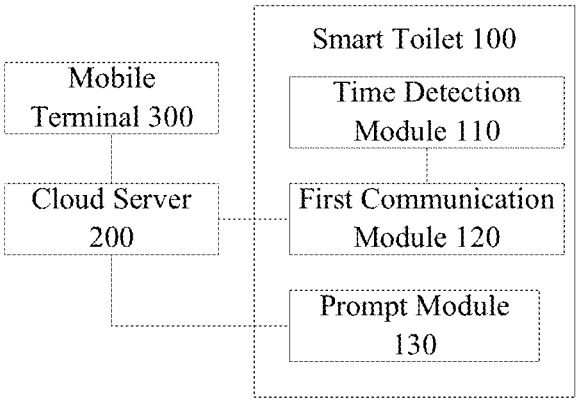
FIG. 10 is a block diagram of a smart toilet provided by one embodiment of the present disclosure.

FIG. 10 is a block diagram of a smart toilet provided by the embodiment of the present disclosure. As shown in FIG. 10, the smart toilet 100 comprises: a time detection module 110, a first communication module 120 and a prompt module 130.

The time detection module 110 is configured to detect the toilet time of the user. The first communication module 120 is configured to establish communication junction between the smart toilet 100 and a cloud server 200, and send the toile time to the cloud server 200 based on the communication connection between the smart toilet 200 and the cloud server 200, so that the cloud server 200 can generate first prompt information by analyzing the toilet time according to a stored toilet data model, and send the first prompt information to the smart toilet 100. The prompt module 130 is configured to prompt the user according to the first prompt information when receiving the first prompt information.

For instance, as shown in FIG. 2, the smart toilet 100 further comprises a toilet seat a, and the time detection module 110 includes a pressure sensor 1, a contact sensor 2 and a time meter 3 disposed on the toilet seat a, wherein the pressure sensor 1 is configured to detect the pressure applied by the user to the toilet seat a when going to the toilet, and the contact sensor 2 is configured to detect whether the skin contacts the toilet seat a. When the pressure detected by the pressure sensor 1 is greater than the preset pressure and the contact sensor 2 detects that the skin contacts the toilet seat a, the time meter 3 starts timing; and when the pressure detected by the pressure sensor 1 is less than or equal to the preset pressure or the contact sensor 2 detects that the skin does not contact the toilet seat a, the time meter 3 stops timing, and the time detection module 110 acquires the toilet time of the user according to the timing time of the time meter 3.

In one embodiment of the present disclosure, as shown in FIG. 3, the smart toilet 100 may further comprise: a toilet lid b, and a fall detection module is disposed on the toilet lid b and includes a camera 4. The fall detection module adopts the camera 4 to capture an image to detect the behavioral posture of the user, determines whether the user falls according to the behavioral posture, and generates second alarm information when the user falls; and the first communication module sends the second alarm information to the cloud server 200, so that the cloud server 200 can forward the second alarm information to the mobile terminal 300. The mobile terminal 300 is also configured to give an alarm in the second way when receiving the second alarm information.

Figure 11:
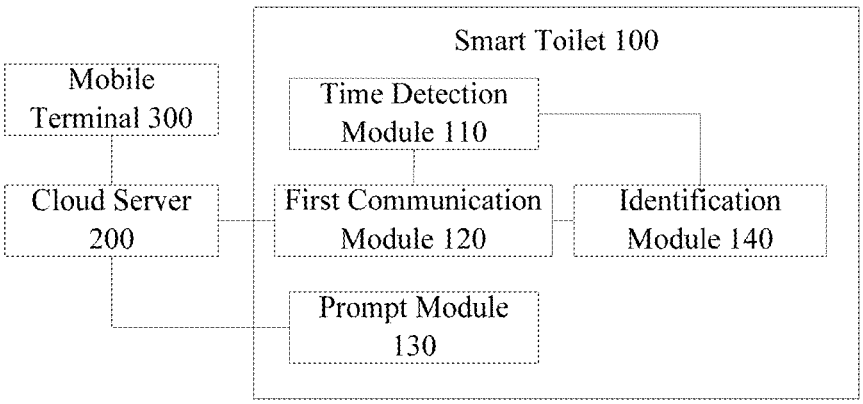
FIG. 11 is a block diagram of a smart toilet provided by another embodiment of the present disclosure.

In one embodiment of the present disclosure, as shown in FIG. 11, the smart toilet 100 further comprises an identification module 140. The identification model 140 is configured to collect identity information of the user and verify the identity information, and when the verification is passed, the time detection module begins to detect the toilet time of the user, and the fall detection module beings to detect whether the user falls.

It should be noted that the specific embodiments of the smart toilet provided by the embodiment of the present disclosure may refer to the specific embodiments of the above safety monitoring system based on the smart toilet, so no further description will be given here to reduce redundancy.

In the smart toilet provided by the embodiment of the present disclosure, the toilet time of the user is detected by the time detection module; the communication connection between the smart toilet and the cloud server is established through the first communication module; the toilet time is sent to the cloud server based on the communication connection between the smart toilet and the cloud server, so that the cloud server can generate the first prompt information by analyzing the toilet time according to the stored toilet data model, and send the first prompt information to the smart toilet; and the prompt module prompts the user according to the first prompt information when receiving the first prompt information. Thus, the user can keep abreast of one's own health status and take timely and relevant preventive measures.

Figure 12:
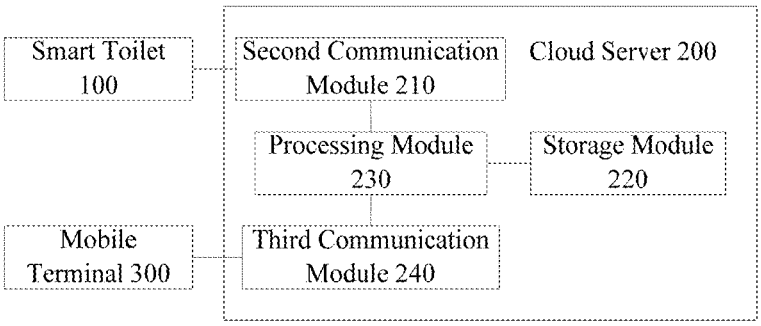
FIG. 12 is a block diagram of a cloud server provided by one embodiment of the present disclosure.

FIG. 12 is a block diagram of a cloud server provided by the embodiment of the present disclosure. As shown in FIG. 12, the cloud server 200 comprises: a second communication module 210, a storage module 220, a processing module 230 and a third communication module 240.

The second communication module 210 is configured to establish communication connection between the cloud server 200 and the smart toilet 100, and receive the toilet time of the user, detected and sent by the smart toilet 100, based on the communication connection between the cloud server 200 and the smart toilet 100. The storage module 120 is configured to store a toilet data model of the user. The processing module 230 is configured to generate first prompt information or first alarm information by analyzing the toilet time according to the toilet data model of the user. The third communication module 240 is configured to establish communication connection between the cloud server 200 and the mobile terminal 300, and send the first alarm information to the mobile terminal 300 based on the communication connection between the cloud server 200 and the mobile terminal 300, so that the mobile terminal 300 can give an alarm in the first way when receiving the first alarm information. The second communication module 210 is also configured to send the first prompt information to the smart toilet 100 based on the communication connection between the cloud server 200 and the smart toilet 100, so that the smart toilet 100 can prompt the user according to the first prompt information when receiving the first prompt information.

In one embodiment of the present disclosure, the second communication module 210 is also configured to receive the second alarm information sent by the smart toilet 100 based on the communication connection between the cloud server 200 and the smart toilet 100, and forward the second alarm information to the mobile terminal 300 through the third communication module 240, so that the mobile terminal 300 can give an alarm in the second way when receiving the second alarm information. The smart toilet 100 generates the second alarm information when detecting that the user falls.

Figure 13:
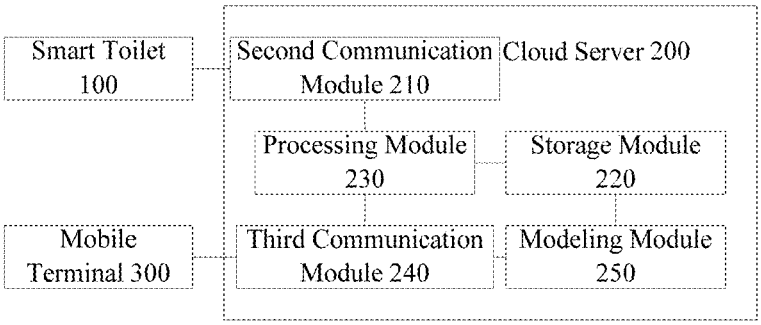
FIG. 13 is a block diagram of a cloud server provided by another embodiment of the present disclosure.

In one embodiment of the present disclosure, as shown in FIG. 13, the cloud server 200 may further comprise: a modeling module 250. The modeling module 250 is configured to establish a toilet data model based on the smart toilet 100 according to identity information, health data and control parameters of the user to be monitored and ID information of the smart toilet 100. The third communication module 240 is also configured to receive the identity information, the health data and the control parameters of the user to be monitored and the ID information of the smart toilet 100, entered by the mobile terminal 300, based on the communication connection between the cloud server 200 and the mobile terminal 300.

The control parameters include first preset time and second preset time, and the first preset time is greater than the second preset time. The processing module 230 is configured to: generate first alarm information when the toilet time is greater than the first preset time or a number of times for which the toilet time has sustainable growth reaches a preset value; and generate first prompt information when the toilet time is less than or equal to the first preset time and greater than the second preset time.

Figure 14:
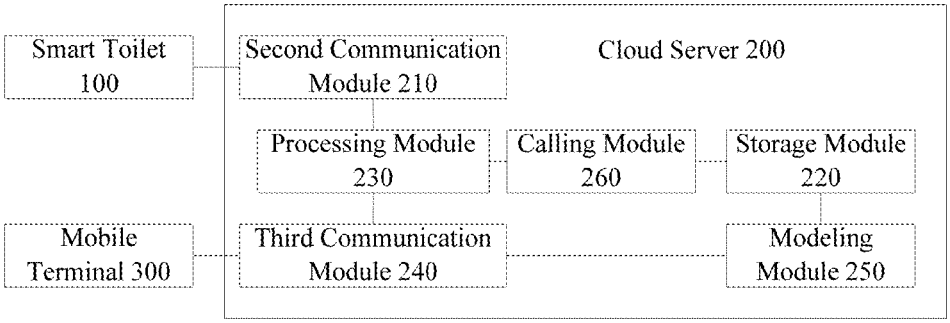
FIG. 14 is a block diagram of a cloud server provided by still another embodiment of the present disclosure.

In one embodiment of the present disclosure, as shown in FIG. 14, the cloud server 200 may further comprise: a calling module 260. The calling module 260 is configured to call the toilet data model of the user corresponding to the identity information, stored in the storage module 220, when the verification of the identity information of the user is passed by the smart toilet 100.

It should be noted that the specific embodiments of the cloud server provided by the embodiment of the present disclosure may refer to the specific embodiments of the above safety monitoring system based on the smart toilet, so no further description will be given here to reduce redundancy.

In the cloud server provided by the embodiment of the present disclosure, the second communication module is adopted to establish the communication connection between the cloud server and the smart toilet and receive the toilet time of the user, detected by the smart toilet and sent by the smart toilet, based on the communication connection between the cloud server and the smart toilet; the processing module is adopted to generate the first prompt information or the first alarm information by analyzing the toilet time according to the toilet data model of the user stored in the storage module; the third communication module is adopted to establish the communication connection between the cloud server and the mobile terminal and send the first alarm information to the mobile terminal based on the communication connection between the cloud server and the mobile terminal, so that the mobile terminal can give an alarm in the first way when receiving the first alarm information; or the second communication module is adopted to send the first prompt information to the smart toilet based on the communication connection between the cloud server and the smart toilet, so that the smart toilet can prompt the user according to the first prompt information when receiving the first prompt information. Thus, the user or his family can be made aware of the health status of the user in time, and it is convenient to take preventive measures in time when the user's health deteriorates.

Figure 15:
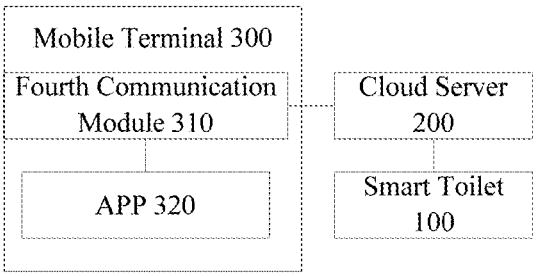
FIG. 15 is a block diagram of a mobile terminal provided by the embodiment of the present disclosure.

FIG. 15 is a block diagram of a mobile terminal provided by the embodiment of the present disclosure. As shown in FIG. 15, the mobile terminal 300 comprises: a fourth communication module 310 and an application (APP) 320.

The fourth communication module 310 is configured to establish communication connection between the mobile terminal 300 and the cloud server 200. The APP 320 is configured to receive the first alarm information sent by the cloud server 200 through the fourth communication module 310, and give an alarm in the first way according to the first alarm information. The smart toilet 100 sends the detected toilet time of the user to the cloud server 200, and the cloud server 200 generates first alarm information by analyzing the toilet time according to the stored toilet data model.

In some embodiments of the present disclosure, the APP 320 is also configured to: generate confirmation information according to an input instruction, and send the confirmation information to the cloud server 200 through the fourth communication module 310, so that the cloud server 200 can stop sending the first alarm information and/or the second alarm information; generate voice connection information according to the input instruction, and send the voice connection information to the cloud server 200 through the fourth communication module 310, so that the cloud server 200 can realize the voice communication between the mobile terminal 300 and the smart toilet 100 according to the voice connection information; and generate view information according to the input instruction, receive the health status of the user that goes to the toilet pushed by the cloud server 200 through the fourth communication module 310 according to the view information, and display the health status of the user that goes to the toilet.

In some embodiments of the present disclosure, the APP 310 is also configured to: enter identity information, health data and control parameters of the user to be monitored and ID information of the smart toilet 100 according to a received information entry instruction; and the fourth communication module 310 sends the identity information, the health data and the control parameters of the user to be monitored and the ID information of the smart toilet 100 to the cloud server 200, so that the cloud server 200 can establish a toilet data model based on the smart toilet 100 according to the identity information, the health data and the control parameters of the user to be monitored and the ID information of the smart toilet 100.

For instance, the control parameters include first preset time. The cloud server 200 generates the first alarm information when the toilet time is greater than the first preset time or a number of times for which the toilet time has sustainable growth reaches a preset value.

It should be noted that the specific embodiments of the mobile terminal provided by the embodiment of the present disclosure may refer to the specific embodiments of the above safety monitoring system based on the smart toilet, so no further description will be given here to reduce redundancy.

In the mobile terminal provided by the embodiment of the present disclosure, the fourth communication module is adopted to establish the communication connection between the mobile terminal and the cloud server; and the APP is adopted to receive the first alarm information sent by the cloud server through the fourth communication module, and give an alarm in the first way according to the first alarm information. Thus, the user's family can be made aware of the health status of the user in time, and it is convenient to take preventive measures in time when the user's health deteriorates.

In addition, the terms "first" and "second" are used for descriptive purposes only and are not to be construed as indicating or implying relative importance or implicitly indicating the number of indicated technical features. Thus, the features defined by "first" and "second" may explicitly or implicitly include at least one of the features. In the description of the present disclosure, the meaning of "a plurality" is at least two, e.g., two, three, etc., unless specifically defined otherwise.

Any process or method description in the flowcharts or otherwise described herein may be understood to represent a module, segment or portion of a code that includes one or more executable instructions for implementing the steps of a particular logical function or process. Moreover, it should be understood by those skilled in the art that the scope of the embodiments of the present disclosure includes additional implementations, in which the functions may be not executed in the shown or discussed order but executed in a substantially simultaneous manner or in an opposite order depending on the involved functions.

The logic and/or steps represented in the flowchart or otherwise described herein, for example, may be considered as an ordered list of executable instructions for implementing logical functions, and may be embodied in any computer readable medium, so as to be used by an instruction execution system, apparatus or device (e.g., a computer-based system, a system including a processor, or other system that can acquire instructions and execute instructions from an instruction execution system, apparatus or device), or used in conjunction with these instruction execution systems, apparatuses or devices. For the description, a "computer-readable medium" can be any apparatus that can contain, store, communicate, propagate, or transmit a program for use in an instruction execution system, apparatus or device, or use in conjunction with the instruction execution system, apparatus or device. More specific examples (non-exhaustive list) of computer readable media include the following: electrical connections (electronic devices) having one or more wires, portable computer disk cartridges (magnetic devices), random access memory (RAM), read-only memory (ROM), erasable programmable read-only memory (EPROM or flash memory), optical fiber devices, and portable compact disk read-only memory (CDROM). In addition, the computer readable medium may even be paper or other suitable medium on which the program can be printed, as the paper or other media may be optically scanned, for example, followed by editing, interpretation or, if necessary, other suitable processing means to electronically obtain the program which is then stored in a computer memory.

It should be understood that the parts of the present disclosure can be implemented in hardware, software, hardware, or a combination thereof. In the above embodiments, multiple steps or methods may be implemented by hardware or software stored in a memory and executed by a suitable instruction execution system. For example, if implemented by hardware, as in another embodiment, it can be implemented by any one or a combination of the following techniques well known in the art: a discrete logic circuit having logic gates for implementing logic functions on data signals, an application-specific integrated circuit (ASIC) with suitable combinational logic gates, a programmable gate array (PGA), a field programmable gate array (FPGA), etc.

It should be understood by those skilled in the art that all or part of the steps carried by the method of implementing the above embodiments can be completed by a program to instruct related hardware, and the program can be stored in a computer readable storage medium. When executed, the program includes one or a combination of the steps of the method embodiments.

In addition, each functional unit in the embodiments of the present disclosure may be integrated into one processing module, or each unit may exist physically and separately, or two or more units may be integrated into one module. The above integrated modules not only can be implemented in the form of hardware but also can be implemented in the form of software functional modules. The integrated module can also be stored in a computer readable storage medium if it is implemented in the form of a software functional module and sold or used as a standalone product.

The above-mentioned storage medium may be an ROM, a magnetic disk, an optical disk, etc. While the embodiments of the present disclosure have been shown and described above, it should be understood that the foregoing embodiments are illustrative and are not to be construed as limiting the scope of the prevent disclosure. Changes, modifications, substitutions and variations of the above embodiments may be made to the above embodiments by those skilled in the art within the scope of the present disclosure.

The foregoing is merely exemplary embodiments of the disclosure, but is not used to limit the protection scope of the disclosure. The protection scope of the disclosure shall be defined by the attached claims.

The invention claimed is:

1. A safety monitoring system based on a smart toilet, comprising:

the smart toilet, a cloud server and a mobile terminal, wherein the smart toilet is configured to detect a toilet time of a user and send the toilet time to the cloud server;

the cloud server is configured to store a toilet data model of the user, analyze the toilet time according to the toilet data model, generate first prompt information, and send the first prompt information to the smart toilet;

the smart toilet is further configured to prompt the user according to the first prompt information when receiving the first prompt information, wherein the cloud sever is further configured to generate first alarm information and send the first alarm information to the mobile terminal, and the mobile terminal is configured to give an alarm when receiving the first alarm information;

wherein the smart toilet includes a toilet seat, a pressure sensor, a contact sensor and a time meter that are provided on the toilet seat, wherein the pressure sensor is configured to detect a pressure applied by the user to the toilet seat when going to the toilet, and wherein the contact sensor is configured to detect whether a skin contacts the toilet seat; and wherein, when the pressure detected by the pressure sensor is greater than a preset pressure and the contact sensor detects that the skin contacts the toilet seat, the time meter starts timing, when the pressure detected by the pressure sensor is less than or equal to the preset pressure or the contact sensor detects that the skin does not contact the toilet seat, the time meter stops timing, and wherein the smart toilet acquires the toilet time of the user according to a timing time of the time meter.

2. The safety monitoring system based on the smart toilet according to claim 1, wherein the smart toilet further includes a toilet lid; the toilet lid is provided with a camera thereon; the smart toilet is further configured to:

detect a behavioral posture of the user through an image of the user captured by the camera, determine if the user falls according to the behavioral posture, and generate second alarm information when the user falls; the cloud server sends the second alarm information to the mobile terminal; and the mobile terminal is further configured to give an alarm when receiving the second alarm information.

3. The safety monitoring system based on the smart toilet according to claim 2, wherein the mobile terminal is further configured to:

generate confirmation information according to an input instruction, and send the confirmation information to the cloud server, so that the cloud server stops sending the first alarm information and/or the second alarm information.

4. The safety monitoring system based on the smart toilet according to claim 3, wherein the mobile terminal is further configured to:

generate voice connection information according to the input instruction, and send the voice connection information to the cloud server, so that the cloud server realizes the voice communication between the mobile terminal and the smart toilet according to the voice connection information; and generate view information according to the input instruction, and display the health status of the user that goes to the toilet pushed by the cloud server according to the view information.

5. The safety monitoring system based on the smart toilet according to claim 2, the mobile terminal is configured to give the alarm in a first way when receiving the first alarm information, and the mobile terminal is configured to give the alarm in a second way when receiving the second alarm information.

6. The safety monitoring system based on the smart toilet according to claim 1, wherein the mobile terminal is further configured to:

enter identity information, health data and control parameters of a user to be monitored and ID information of the smart toilet according to the received information, and send the identity information, the health data and the control parameters of the user to be monitored and the ID information of the smart toilet to the cloud server; and the cloud server is further configured to establish a toilet data model based on the smart toilet according to the identity information, the health data and the control parameters of the user to be monitored and the ID information of the smart toilet.

7. The safety monitoring system based on the smart toilet according to claim 6, wherein the control parameters include first preset time and second preset time; the first preset time is greater than the second preset time;

the cloud server generates the first alarm information when the toilet time is greater than the first preset time or a number of times for which the toilet time has sustainable growth reaches a preset value; and the cloud server generates the first prompt information when the toilet time is less than the first preset time and greater than the second preset time.

8. The safety monitoring system based on the smart toilet according to claim 6, wherein the smart toilet is further configured to:

acquire the identity information of the user, verify the identity information, and start detecting the toilet time of the user and detecting if the user falls when the verification is passed; and the cloud server is further configured to acquire the toilet data model corresponding to the identity information when the verification is passed.

9. A smart toilet, comprising:

a time detection module configured to detect toilet time of a user;

a first communication module configured to establish communication connection between the smart toilet and a cloud server and send the toilet time to the cloud server based on the communication connection between the smart toilet and the cloud server, so that the cloud server analyzes the toilet time according to a stored toilet data model, generate first prompt information, and send the first prompt information to the smart toilet;

a prompt module configured to prompt the user according to the first prompt information when receiving the first prompt information;

the smart toilet further comprising a toilet seat, wherein the time detection module includes a pressure sensor, a contact sensor and a time meter on the toilet seat, wherein the pressure sensor is configured to detect a pressure applied by the user to the toilet seat when going to the toilet, and wherein the contact sensor is configured to detect whether a skin contacts the toilet seat; and wherein, when the pressure detected by the pressure sensor is greater than a preset pressure and the contact sensor detects that the skin contacts the toilet seat, the time meter starts timing, and when the pressure detected by the pressure sensor is less than or equal to the preset pressure or the contact sensor detects that the skin does not contact the toilet seat, the time meter stops timing, and wherein the time detection module acquires the toilet time of the user according to a timing time of the time meter.

10. The smart toilet according to claim 9, further comprising:

a toilet lid, wherein a fall detection module is provided on the toilet lid and includes a camera; the fall detection module detects a behavioral posture of the user through an image of the user captured by the camera, determines if the user falls according to the behavioral posture, and generates second alarm information when the user falls, and the first communication module sends the second alarm information to the cloud server, so that the cloud server forwards the second alarm information to the mobile terminal; and the mobile terminal is further configured to give an alarm in a second way when receiving the second alarm information.

11. The smart toilet according to claim 9, further comprising:

an identification module configured to acquire identity information of the user and verify the identity information; and when the verification is passed, the time detection module starts detecting the toilet time of the user, and the fall detection module starts detecting if the user falls.

* * * * *